United States Patent [19]

Endo et al.

[11] Patent Number: 4,493,888

[45] Date of Patent: Jan. 15, 1985

[54] SILVER HALIDE PHOTOGRAPHIC LIGHT-SENSITIVE MATERIAL

[75] Inventors: Katsusuke Endo; Eiichi Kato; Nobutaka Ohki; Takatoshi Ishikawa, all of Kanagawa, Japan

[73] Assignee: Fuji Photo Film Co., Ltd., Kanagawa, Japan

[21] Appl. No.: 514,216

[22] Filed: Jul. 15, 1983

[30] Foreign Application Priority Data

Jul. 15, 1982 [JP] Japan ..... 57-123309

[51] Int. Cl.[3] ..... G03C 5/24; G03C 1/02

[52] U.S. Cl. ..... 430/405; 430/443; 430/447; 430/448; 430/566; 430/959

[58] Field of Search ..... 430/566, 443, 955, 447, 430/959, 448, 551, 17, 505, 405

[56] References Cited

U.S. PATENT DOCUMENTS 4,245,018 1/1981 Hara et al. ..... 430/17

*Primary Examiner*—Mary F. Downey

*Attorney, Agent, or Firm*—Sughrue, Mion, Zinn, Macpeak and Seas

[57] ABSTRACT

A silver halide photographic light-sensitive material containing a diffusion resistant coupler, a light-sensitive silver halide and at least one organic metal complex represented by the following general formula (I) in the same layer or different layers on a support.

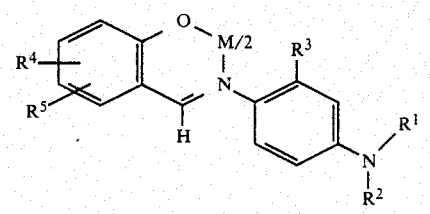

wherein M represents a divalent metal atom; $R^1$ and $R^2$, which may be the same or different, each represents an alkyl group having from 1 to 5 carbon atoms, a hydroxyalkyl group having from 1 to 5 carbon atoms, an alkoxyalkyl group having from 2 to 10 carbon atoms or an alkylsulfonamidoalkyl group having from 2 to 10 carbon atoms, or $R^1$ and $R^2$ may be bonded each other to form a heterocyclic ring together with the nitrogen atom; $R^3$, represents a hydrogen atom, an alkyl group having from 1 to 5 carbon atoms or an alkoxy group having from 1 to 5 carbon atoms; and $R^4$ and $R^5$, which may be the same or different, each represents a hydrogen atom, a halogen atom, a hydroxy group, an amino group, a carboxylic acid group, a sulfonic acid group, an alkoxycarbonyl group, an alkyl group or an alkoxy, or $R^4$ and $R^5$ may be bonded to each other to form a 5-membered or 6-membered ring.

The compound represented by the general formula (I) is a precursor of a color developing agent which provides a sufficiently high color density on development and causes less desensitization and little fog or stain formation during storage of the photographic light-sensitive material containing thereof. A method of forming a color photographic image using the silver halide photographic light-sensitive material is also disclosed.

8 Claims, No Drawings

SILVER HALIDE PHOTOGRAPHIC LIGHT-SENSITIVE MATERIAL

FIELD OF THE INVENTION

The present invention relates to a photographic light-sensitive material. More particularly, the present invention relates to a silver halide photographic light-sensitive material containing a precursor of a color developing agent.

BACKGROUND OF THE INVENTION

A general process for forming a color image with a photographic light-sensitive material such as a color photographic light-sensitive material comprises developing a silver halide photographic light-sensitive material using an aromatic primary amine developing agent in the presence of a color coupler having the ability to form a dye by reacting with an oxidation product of the developing agent to form an azomethine dye or an indoaniline dye. This color development process which was invented originally by L. D. Mannes and L. Godowsky in 1935 and which has been improved has now been used widely all over the world in the photographic field.

The processing of color photographic light-sensitive materials essentially comprises the following three steps:

(1) a color development step, (2) a bleaching step, (3) a fixing step.

The bleaching step and the fixing step may be carried out at the same time. Namely, a bleach-fixing step (the so-called blix step), by which developed silver and undeveloped silver halide are removed can be used. In actual development processing, auxiliary steps for maintaining the photographic or physical quality of the images formed or the improving the storage stability of the images, etc. are employed in addition to the above described two essential steps consisting of color development and silver-removal. For example, steps using a bath such as a hardening bath for preventing an excessive softening of the light-sensitive layers during processing, a stopping bath for effectively stopping the development reaction, a stabilizing bath for stabilizing the images formed or a defilming bath for removing a backing layer on the support can be employed.

Usually, an aromatic primary amine developing agent is dissolved in an aqueous alkaline solution and used as a color developing solution. If the aromatic primary amine development agent is incorporated in the light-sensitive material, the development can be essentially carried out using only an aqueous alkaline solution. Consequently, the developing solution can be easily prepared and the change in the composition of the developing solution becomes to a lesser extent. Accordingly, it is easy to control of the developing solution. Further, there are many advantages in that the BOD of the waste liquor is decreased markedly and treatment of the waste liquor is easy. However, incorporation of an aromatic primary amine developing agent into a light-sensitive material is not now generally utilized because many disadvantages such as desensitization of the light-sensitive material and occurrence of fogs or stains during storage, or insufficient color formation in the processing, etc. occur.

A black-and-white developing agent such as hydroquinone or catechol, etc. can be incorporated into the light-sensitive material in a comparatively stable state. For example, U.S. Pat. No. 3,295,978 discloses that such a developing agent can be incorporated into the light-sensitive material as a metal complex salt. On the contrary, the aromatic primary amine developing agent is difficult to incorporate into the light-sensitive material in a stable manner because of their lack of stability.

Several methods for incorporating an aromatic primary amine developing agent into a light-sensitive material are known. For example, U.S. Pat. No. 3,342,599 describes the use of a Schiff base of an aromatic primary amine developing agent with salicylaldehyde as a precursor of a developing agent. U.S. Pat. No. 3,719,492 discloses the use of a combination of a metal salt such as a lead or cadmium salt with an aromatic primary amine developing agent. In British Pat. No. 1,069,061, a phthalimide type precursor prepared by reacting an aromatic primary amine with phthalic acid is used. Other known methods are described in German Pat. Nos. 1,159,758 and 1,200,679, U.S. Pat. No. 3,705,035, etc. However, all of the requirements of a formation of sufficient color density on development, a lack of desensitization and the elimination of the occurrence of fogs or stains on storage of the light-sensitive material can not be obtained using any of these prior art techniques.

SUMMARY OF THE INVENTION

An object of the present invention is to provide a technique for incorporating a precursor of an aromatic primary amine developing agent into a light-sensitive material, which results in a sufficiently high color density on development, less desensitization and little occurrence of fog or stains during storage of the light-sensitive material even though a precursor of an aromatic primary amine developing agent is incorporated into the light-sensitive material.

Other objects of the present invention will be apparent from the following detailed description and examples.

The objects of the present invention can be attained by a silver halide photographic light-sensitive material containing a diffusion resistant coupler, a light-sensitive silver halide and at least one organic metal complex represented by the following general formula (I) in the same layer or different layers on a support.

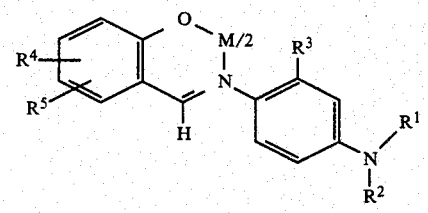

wherein M represents a divalent metal atom; $R^1$ and $R^2$, which may be the same or different, each represents an alkyl group having from 1 to 5 carbon atoms, a hydroxyalkyl group having from 1 to 5 carbon atoms, an alkoxyalkyl group having from 2 to 10 carbon atoms or an alkylsulfonamidoalkyl group having from 2 to 10 carbon atoms, or $R^1$ and $R^2$ may be bonded each other to form a heterocyclic ring together with the nitrogen atom; $R^3$, represents a hydrogen atom, an alkyl group having from 1 to 5 carbon atoms or an alkoxy group having from 1 to 5 carbon atoms; and $R^4$ and $R^5$, which may be the same or different, each represents a hydrogen atom, a halogen atom, a hydroxy group, an amino group, a carboxylic acid group, a sulfonic acid group, an alkoxycarbonyl group, an alkyl group or an alkoxy, or $R^4$ and $R^5$ may be bonded each other to form a 5-membered or 6-membered ring.

DETAILED DESCRIPTION OF THE INVENTION

In the general formula (I), M represents a divalent metal atom (for example, iron, cobalt, nickel, copper, zinc, etc.). $R^1$ and $R^2$, which may be the same or different, each represents an alkyl group having from 1 to 5 carbon atoms (for example, a methyl group, an ethyl group, a butyl group, etc.), a hydroxyalkyl group having from 1 to 5 carbon atoms (for example, a hydroxymethyl group, a hydroxyethyl group, a hydroxypropyl group, etc.), an alkoxyalkyl group having from 2 to 10 carbon atoms (for example, a methoxyethyl group, a butoxymethyl group, a propoxyethyl group, etc.) or an alkylsulfonamidoalkyl group having from 2 to 10 carbon atoms (for example, a methylsulfonamidoethyl group, etc.). $R^3$ represents a hydrogen atom, an alkyl group having from 1 to 5 carbon atoms (for example, a methyl group, an ethyl group, a butyl group, etc.) or an alkoxy group having from 1 to 5 carbon atoms (for example, a methoxy group, an ethoxy group, a butoxy group, etc.). $R^4$ and $R^5$, which may be the same or different, each represents a hydrogen atom, a halogen atom (for example, a chlorine atom, a bromine atom, etc.), a hydroxy group, an amino group, a carboxylic acid group, a sulfonic acid group, an alkoxycarbonyl group (preferably, an alkoxycarbonyl group having from 2 to 5 carbon atoms, for example, a methoxycarbonyl group, an ethoxycarbonyl group, etc.), an alkyl group (preferably, an alkyl group having from 1 to 5 carbon atoms, for example, a methyl group, an ethyl group, a butyl group, etc.) or an alkoxy group (preferably an alkoxy group having from 1 to 5 carbon atoms, for example, a methoxy group, an ethoxy group, a butoxy group, etc.) or $R^4$ and $R^5$ may be bonded to each other to form a 5-membered or 6-membered ring (for example, a naphthalene ring, etc.).

The precursor of an aromatic primary amine developing agent represented by the general formula (I) described above is a salicylaldimine complex of a paraphenylenediamine type compound.

Examples of preferred compounds of the precursors represented by the above described general formula (I) include precursors of aromatic primary amine developing agent wherein $R^1$ and $R^2$ each represents an alkyl group having from 1 to 5 carbon atoms and $R^3$ represents an alkyl group having from 1 to 5 carbon atoms (particularly, a methyl group, etc.).

Specific examples of compounds represented by the general formula (I) above which can be used in the present invention are described below. However, the present invention is not to be construed as being limited to these compounds only.

Compound (1)

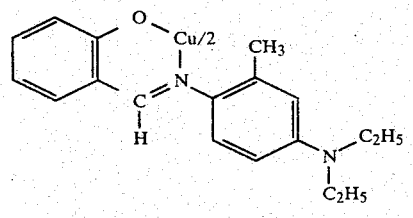

-continued

Compound (2)

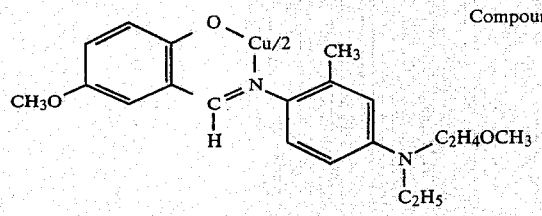

Compound (3)

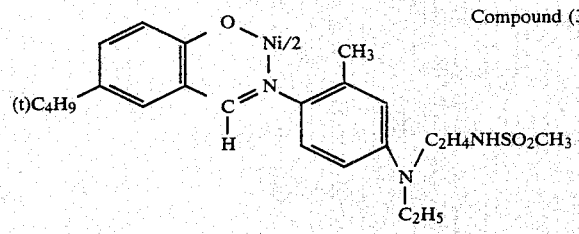

Compound (4)

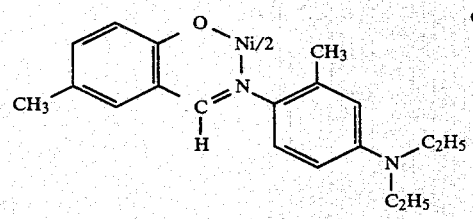

Compound (5)

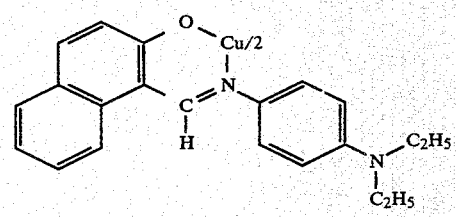

Compound (6)

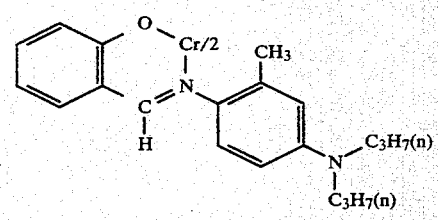

Compound (7)

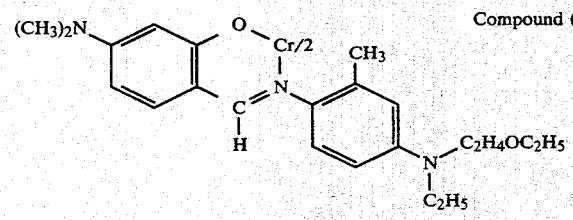

Compound (8)

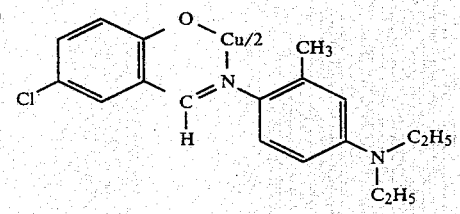

-continued

Compound (9)

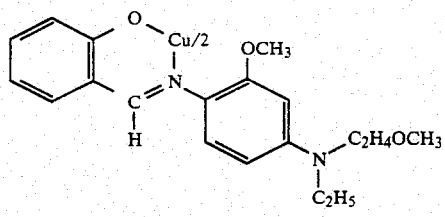

Compound (10)

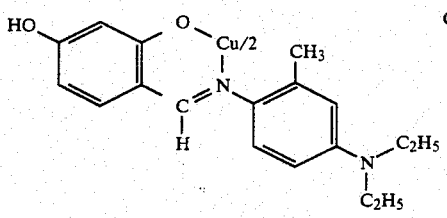

Compound (11)

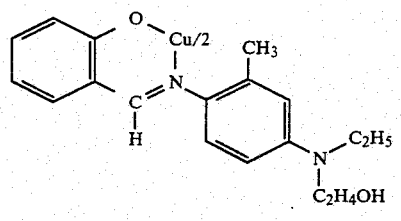

Compound (12)

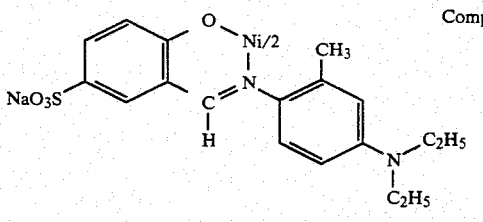

In addition to the specific examples of the compounds described above, those described in F. A. Cotton, *Progress in Inorganic Chemistry,* Vol. 7, pages 83 (Interscience Publishers) can also be employed.

The compounds represented by the general formula (I) described above can be synthesized in accordance with the methods described below or with reference to these methods.

SYNTHESIS EXAMPLE 1

Synthesis of copper (II) bis(salicylaldehydate).dihydrate 20.0 g of cupric acetate.monohydrate was dissolved in 1200 ml of a solvent mixture of ethanol and water (1:1). To the solution was added dropwise 30.0 g of salicylaldehyde at room temperature over a period of 10 minutes with stirring. The mixture was continually stirred for 3 hours while the crystals deposited. The crystals were collected by filtration, washed with water then ethanol and dried under reduced pressure to obtain 32 g of the desired compound having dark green color. A melting point of the compound was above 270° C. The structure of the compound was confirmed using elemental analysis, mass spectrum, etc.

Elemental Analysis for $C_{14}H_{10}CuO_2.2H_2O$: Calculated (%): C: 54.28, H: 4.55: Found (%): C: 54.49, H: 4.61.

SYNTHESIS EXAMPLE 2

Synthesis of Compound (1)

3.0 g of copper (II) bis(salicylaldehydate).dihydrate obtained in Synthesis Example 1 was added to 300 ml of ethanol and the mixture was refluxed with stirring while being heterogeneous to which was added 3.6 g of 2-amino-5-diethylaminotoluene purified by distillation. The mixture was further refluxed by heating for 1 hour. The system became homogeneous. After being allowed to cool, the mixture was filtered at room temperature to remove the insoluble substance and the solution was concentrated. The crystals thus deposited were collected by filtration, washed with cold ethanol and dried to obtain 3.8 g of the desired compound having black-brown color. A melting point of the compound was 131° to 132° C. The structure of the compound was confirmed using NMR spectrum, mass spectrum, etc.

Elemental Analysis for $C_{36}H_{42}CuN_4O_2$: Calculated (%): C: 69.04, C: 6.76, N: 8.95: Found (%): C: 68.89, H: 6.70, N: 8.73.

Other compounds can be synthesized in a similar manner to the method described above.

The compound represented by the general formula (I) above may be dispersed in a hydrophilic colloid solution directly in various concentrations where the compound is water soluble or the compound may be dispersed in a hydrophilic colloid solution using a latex or other polymers or using an oil/water emulsion type dispersion method where the compound is not water-soluble. Examples of the oils which can be used for the oil/water emulsion type dispersion method include oils for dissolving couplers used for oil protected type light-sensitive materials. For example, tri-o-cresyl phosphate, trihexyl phosphate, dioctyl butyl phosphate, dibutyl phthalate, diethyllaurylamide, 2,4-diallyl phenol and octyl benzoate, etc., can be used.

In order to disperse an oil phase containing the compound dissolved therein into an aqueous phase, a conventional surface active agent can be used. For example, an anionic surface active agent having an acid group such as a carboxylic acid group, a sulfonic acid group, phosphoric acid group, a sulfuric acid ester group or a phosphoric acid ester group, etc. and a non-ionic, cationic or amphoteric surface active agent can be used.

Suitable hydrophilic colloids which can be used include materials known as photographic binders such as gelatin. For example, a gelatin derivative, a graft polymer of gelatin with other high molecular weight materials, a cellulose derivative such as hydroxyethylcellulose, carboxymethylcellulose or cellulose sulfate, etc., sodium alginate, a starch derivative, various kinds of synthetic hydrophilic high molecular weight materials, such as a homo- or copolymer such as polyvinyl alcohol partial acetal, poly-N-vinylpyrrolidone, polyacrylic acid, polymethacrylic acid, polyacrylamide, polyvinylimidazole or polyvinyl pyrazole, etc., can be used. In some cases, a latex may be employed. Examples of these binders include the compounds described in U.S. Pat. No. 3,518,088 and *Research Disclosure,* August 1976, No. 148-14850.

Further, it is possible to employ known photographic antioxidant or stabilizer in the emulsion. For example, a hydroquinone derivative, a reductone such as ascorbic acid, a hydroxylamine, a sulfonyl compound, an active methylene compound, etc. can be employed in the emulsion.

The coating amount of the precursor of the color developing agent used in the present invention, which depends upon the amount of silver, the kind of couplers used and photographic characteristics required, is from 0.1 to 10 molar times and preferably from 0.25 to 5 molar times, the total amount of silver per unit area of the light-sensitive material. When two or more precursors of the color developing agent are used in the present invention, the total amount of those precursor is from 0.1 to 10 molar times and preferably from 0.25 to 5 molar times, the total amount of silver per unit area of the light-sensitive material. The precursor of the color developing agent may be incorporated into a light-sensitive layer containing a silver halide emulsion or into other layers (for example, an intermediate layer, a developing agent containing layer, a protective layer, a subbing layer, etc.).

The silver halide photographic light-sensitive material of the present invention may contain a 1-phenyl-3-pyrazolidone derivative in order to accelerate the development reaction. More specifically, the compounds as described, for example, in U.S. Pat. Nos. 2,751,297 and 3,902,905, Japanese Patent Application (OPI) Nos. 52422/78, 52055/80, 64339/81 and 40245/82, etc. may be used.

The silver halide photographic light-sensitive material of the present invention can be applied not only to a conventional color photographic light-sensitive material using three kinds of couplers, i.e., yellow, magenta and cyan couplers, but also a photographic light-sensitive material using a coupler capable of forming a black image upon color development.

The development processing method of the silver halide photographic light-sensitive material of the present invention can be the method comprising the three steps as described hereinbefore. Also, it can be a method for forming an image comprising a dye and metallic silver in which a bleaching step (silver removing step) is omitted.

The development processing used in the present invention is the same as the conventional development processing except that the developing bath is an alkaline activator bath.

A suitable pH for the activator bath ranges from about 7 to 14 and particularly from about 8 to 13. A suitable temperature at which the activator bath can be used ranges from 20° to 70° C., but a preferred range is 30° to 60° C.

A suitable activator bath used in the present invention is a bath which is the same as a conventional developing solution (for example, a color developing solution) but which does not contain a color developing agent. A suitable buffer which can be used in the activator bath includes sodium hydroxide, potassium hydroxide, sodium carbonate, potassium carbonate, sodium tertiary phosphate, potassium tertiary phosphate, potassium metaborate and borax, etc., which may be used individually or as a combination thereof. Further, it is possible to use various salts such as disodium hydrogen phosphate, dipotassium hydrogen phosphate, sodium dihydrogen phosphate, potassium dihydrogen phosphate, sodium bicarbonate, potassium bicarbonate, boric acid, alkali metal nitrates or alkali metal sulfates, etc. in order to provide a buffering capability, for certain reasons of preparation or for the purpose of increasing the ionic strength.

Moreover, an antifogging agent can be incorporated into the activator bath in a suitable amount. Suitable antifogging agents include an inorganic halide compound and known organic antifogging agents. Typical examples of the inorganic halide compounds include a bromide such as sodium bromide, potassium bromide or ammonium bromide, etc. and an iodide such as potassium iodide or sodium iodide, etc. Examples of the organic antifogging agents include 6-nitrobenzimidazole as described in U.S. Pat. No. 2,496,940, 5-nitrobenzimidazole as described in U.S. Pat. Nos. 2,497,917 and 2,656,271, diaminophenazine and o-phenylenediamine as described in *Nippon Shashingakkaishi*, Vol. 11, page 48 (1948) and a heterocyclic compound such as mercaptobenzimidazole, methylbenzothiazole, mercaptobenzoxazole, thiouracil, 5-methylbenzotriazole or the compounds as described in Japanese Patent Publication No. 41675/71, etc. In addition, the antifogging agents as described in *Kagakushashin Binran*, Vol. 2, page 119, Maruzen Co., (1959) may also be used.

In order to control surface layer development the development restrainers described in Japanese Patent Publication Nos. 19039/71 and 6149/70 and U.S. Pat. No. 3,295,976, etc. can also be used.

In addition, if desired, ammonium chloride, potassium chloride or sodium chloride may be present in the activator bath. Further, if desired, a suitable development accelerator may be used in combination. Examples of the development accelerators include a pyridinium compound as disclosed in U.S. Pat. No. 2,648,604, Japanese Patent Publication No. 9503/69 and U.S. Pat. No. 3,671,247 and other cationic compounds, a cationic dye such as phenosafranine, a neutral salt such as thallium nitrate or potassium nitrate, a nonionic compound such as polyethylene glycol or a derivative thereof or a polythioether, as described in Japanese Patent Publication No. 9504/69 and U.S. Pat. Nos. 2,533,990, 2,531,832, 2,950,970 and 2,577,127, an organic solvent and an organic amine as described in Japanese Patent Publication No. 9509/69 and Belgian Pat. No. 682,862, ethanolamine, ethylenediamine and diethanolamine, etc. In addition, the development accelerators as described in detail in L. F. A. Mason, *Photographic Processing Chemistry*, pages 40–43, Focal Press, London (1966) may be used.

Further, benzyl alcohol and phenethyl alcohol as described in U.S. Pat. No. 2,304,925 and pyridine, ammonia, hydrazine and an amine as described in *Nippon Shashingakkaishi*, Vol. 14, page 74 (1952) can be used as an effective development accelerator in some cases.

Further, it is also possible to employ sodium sulfite, potassium sulfite, potassium bisulfite or sodium bisulfite in the activator bath.

Moreover, a water softener, for example, a polyphosphoric acid compound such as sodium hexametaphosphate, sodium tetrapolyphosphate or sodium tripolyphosphate, or potassium salts of hexametaphosphoric acid, tetrapolyphosphoric acid or tripolyphosphoric acid, etc. and an aminopolycarboxylic acid such as ethylenediaminetetraacetic acid, nitrilotriacetic acid, cyclohexanediaminetetraacetic acid, iminodiacetic acid, N-(hydroxymethyl)ethylenediaminetriacetic acid or diethylenetriamine pentaacetic acid, etc. can be added to the activator bath. Although an amount of the water-softener will vary depending on the hardness of the water used, generally from 0.5 to 10 g/liter is suitable. In addition to this, a calcium or magnesium sequestering agent may be used. Compounds of this type are described in detail in J. Willems *Belgisches Chemiches Industry,* Vol. 21, page 325 (1956) and ibid., Vol. 23, page 1105 (1958).

If desired, an organic solvent can also be employed in the activator bath.

Examples of suitable organic solvents include ethylene glycol, hexylene glycol, diethylene glycol, methyl Cellosolve, methanol, ethanol, acetone, triethylene glycol, dimethylformamide, dimethylsulfoxide and the compounds as described in Japanese Patent Publication Nos. 33378/72 and 9509/69.

Although an amount of the organic solvent can vary over a wide range depending on the composition of the activator bath, a suitable amount is generally less than above 50% by volume and usually less than 10% by volume of the solution used. However, it is possible to use an activator bath containing substantially no water.

An auxiliary developing agent such as N-methyl-p-aminophenol hemisulfate (Metol), benzyl-p-aminophenol hydrochloride, N,N-diethyl-p-aminophenol hydrochloride, p-aminophenol sulfate, phenidone and N,N,N',N'-tetramethyl-p-phenylenediamine hydrochloride, etc., can also be used. A preferred amount of the auxiliary developing agent is generally from 0.01 to 1.0 g/liter of the activator bath.

In addition, the following materials can also be employed, if necessary, in the activator bath.

For example, a competitive coupler (non-color forming coupler) such as citrazinic acid, J-acid or H-acid, e.g., as described in Japanese Patent Publication Nos. 9505/69, 9506/69, 9507/69, 14036/70 and 9508/69, U.S. Pat. Nos. 2,742,832, 3,520,690, 3,560,212 and 3,645,737, etc. can be used.

A fogging agent such as an alkali metal borohydride, aminoborane or ethylenediamine, etc. as described in Japanese Patent Publication No. 38816/72 can be employed.

In color photographic light-sensitive materials wherein a compound which forms a dye by reacting with an oxidized developing agent, the so-called coupler, is incorporated in a light-sensitive photographic emulsion layer, the precursor of a development agent used in the present invention may be added to the same layer as or a different layer than the above described layer.

Such a structure is a particularly advantageous embodiment of the present invention. Such a color coupler has a chemical structure such that it does not diffuse into other layers during production or during processing.

An open chain diketomethylene type compound is widely used in general as a yellow coupler. Examples of suitable yellow couplers are described in, for example, U.S. Pat. Nos. 3,341,331, 2,875,057 and 3,551,155, German Patent Application (OLS) No. 1,547,868, U.S. Pat. Nos. 3,265,506, 3,582,322 and 3,725,072, German Patent Application (OLS) No. 2,162,899, U.S. Pat. Nos. 3,369,895 and 3,408,194 and German Patent Application (OLS) Nos. 2,057,941, 2,213,461, 2,219,917, 2,261,361 and 2,263,875, etc.

Although a 5-pyrazolone type compound is mainly used as a magenta coupler, an indazolone type compound and a cyanoacetyl compound can also be used as a magenta coupler. Examples of suitable magenta couplers are described in, for example, U.S. Pat. Nos. 2,439,098, 2,600,788, 3,062,653, 3,558,319 and 4,163,670, British Pat. No. 956,261, U.S. Pat. Nos. 3,582,322, 3,615,506, 3,519,429, 3,311,476, 3,419,391 and 3,935,015, British Pat. No. 1,470,552, German Pat. No. 1,810,464, Japanese Patent Publication No. 2016/69, and U.S. Pat. No. 2,983,608, etc.

A phenol or naphthol derivative is mainly used as a cyan coupler. Examples of suitable cyan couplers are described in, for example, U.S. Pat. Nos. 2,369,929, 2,474,293, 2,698,794, 2,895,826, 3,311,476, 3,458,315, 3,560,212, 3,582,322, 3,591,383, 3,386,301, 2,434,272, 2,706,684, 3,034,892, 3,583,971 and 3,933,500, German Patent Application (OLS) No. 2,163,811 and Japanese Patent Publication No. 28836/70, etc.

A resorcinol or m-aminophenol derivative is mainly used as a black image forming coupler. Examples of suitable black image forming couplers are described, for example, in Japanese Patent Application (OPI) Nos. 9924/79, 172336/82 and 46029/78, etc.

Further, it is possible to incorporate a development inhibiting compound releasing type coupler (the so-called DIR coupler) or a compound which releases a development inhibiting compound at color coupling reaction into the photographic material. Examples of suitable compounds are described in U.S. Pat. Nos. 3,148,062, 3,227,554, 3,253,924, 3,617,291, 3,622,328 and 3,705,201, British Pat. No. 1,201,110 and U.S. Pat. Nos. 3,297,445, 3,379,529 and 3,639,417, etc.

Two or more of the above described couplers, etc. can be employed in the same layer depending on the characteristics required for the light-sensitive material. Of course, the same compound may be employed in two or more different layers, if desired.

Preferably, the coupler is insoluble in water which is present in a coupler solvent (preferably, a coupler solvent having a suitable polarity). Typical useful coupler solvents are tri-o-cresyl phosphate, dibutyl phthalate, diethyl laurylamide, 2,4-diallylphenol and liquid dye stabilizers described as "improved photographic dye image stabilizing solvents" in *Product Licensing Index,* Vol. 83, pages 26–29 (March 1971).

Preferably the maximum adsorption region of the cyan dye is in the range of about 600 to 680 nm, that of the magenta dye is in the range of about 500 to 580 nm and that of the yellow dye is in the range of about 400 to 480 nm.

The silver halide emulsion used in this invention can, in general, be produced by mixing a solution of a water soluble silver salt (for example, silver nitrate) with a solution of a water soluble halide (for example, potassium bromide) in the presence of a solution of a water soluble high molecular weight material such as gelatin. Not only silver chloride and silver bromide but also mixed silver halide such as silver chlorobromide, silver iodobromide or silver chloroiodobromide, etc. may be used as the silver halide.

The grains of the silver halide may have any shape such as a cubic form, an octahedral form and a mixed crystal form thereof.

The grains of the silver halide can be produced using known conventional methods, such as by the so-called single or double jet process or the controlled double jet process.

Suitable photographic emulsions are described in C. E. K. Mees, *The Theory of the Photographic Process,* MacMillan Co. New York (1966) and P. Grafkides, *Chimie Photographique,* Paul Montel, Paris (1957) and they can be prepared by an ammonia method, a neutral method or an acid method.

After formation of the silver halide grains, the grains are washed with water to remove by-produced water soluble salts (for example, potassium nitrate in the case of producing silver bromide using silver nitrate and potassium bromide) from the system, and they are then heated in a presence of a chemical sensitizing agent (for example, sodium thiosulfate, N,N,N'-trimethylthiourea, a monovalent gold-thiocyanate complex salt, a thiosulfate complex salt, stannous chloride and hexamethylenetetramine, etc.) to increase the sensitivity without increasing the grain size. Such processes are generally described in Mees, supra and Grafkides, supra.

The above-described silver halide emulsion may be chamically sensitized using conventional techniques. Examples of suitable chemical sensitizing agents which can be used include a gold compound (for example, chloroaurate or gold trichloride) as described in U.S. Pat. Nos. 2,399,083, 2,540,085, 2,597,856 and 2,597,915, a salt of a noble metal (for example, platinum, palladium, iridium, rhodium or ruthenium, etc.) as described in U.S. Pat. Nos. 2,448,060, 2,540,086, 2,566,245, 2,566,263 and 2,598,079, a sulfur compound which forms silver sulfide by reacting with a silver salt, as described in U.S. Pat. Nos. 1,574,944, 2,410,689, 3,189,458 and 3,501,313, and a reducing agent (for example, a stannous salt and an amine, etc.) as described in U.S. Pat. Nos. 2,487,850, 2,518,698, 2,521,925, 2,521,926, 2,694,637, 2,983,610 and 3,201,254, etc.

An antifogging agent for silver halide may be added to the light-sensitive layer of the photographic light-sensitive material of the present invention. Typical antifogging agents which can be used are a heterocyclic organic compound such as a tetrazole, an azaindene or a triazole, etc. and an aromatic or heterocyclic compound having a mercapto group.

The layer of the photographic light-sensitive material of the present invention may contain a hardening agent, a plasticizer, a lubricating agent, a surface active agent, a lustering agent and other additives commonly used in the photographic field.

Examples of hydrophilic colloids which can be used include gelatin, colloidal albumin, casein, a cellulose derivative such as carboxymethyl cellulose or hydroxyethyl cellulose, etc., a saccharide derivative such as agar, sodium alginate or a starch derivative, etc. and a synthetic hydrophilic colloid such as polyvinyl alcohol, poly-N-vinyl-pyrrolidone, an acrylic acid copolymer, polyacrylamide, a derivative thereof or a partially hydrolyzed product thereof, etc. If desired, a compatible mixture of two or more of these colloids can be used. Of these colloids, although gelatin is the most generally used, a part or all of the gelatin may be replaced by not only a synthetic high molecular material but also by a gelatin derivative, namely, a material modified by treating gelatin with a reagent having one group capable of reacting with an amino group, an imino group, hydroxy group or a carboxyl group as a functional group in the gelatin molecule, or a graft polymer obtained by grafting the chain of other high molecular weight materials onto gelatin.

The photographic emulsion may be, if desired, spectrally sensitized or supersensitized using one or more cyanine dyes such as a cyanine, merocyanine or hemicyanine dye, etc. or using cyanine dyes together with a styryl dye. These spectral sensitization techniques are known and are described in, for example, U.S. Pat. Nos. 2,493,748, 2,519,001, 2,977,229, 3,480,434, 3,672,897, 3,703,377, 2,688,545, 2,912,329, 3,397,060, 3,615,635 and 3,628,964, British Pat. Nos. 1,195,302, 1,242,588 and 1,293,862, West German Patent Application (OLS) Nos. 2,030,326 and 2,121,780, Japanese Patent Publication Nos. 4936/68, 14030/69 and 10773/68, U.S. Pat. Nos. 3,511,664, 3,522,052, 3,527,641, 3,615,613, 3,615,632; 3,617,295, 3,635,721 and 3,694,217 and British Pat. Nos. 1,137,580 and 1,216,203, etc. Suitable dyes can be selected depending on the purpose or use of the light-sensitive material, such as the wavelength range to be sensitized or the sensitivity desired, etc.

The photographic emulsion is applied to a planar material which does not undergo a marked dimensional change during processing, for example, a rigid support such as glass, metal or porcelain or a flexible support, depending on the end-use. Typical examples of flexible supports, are a cellulose nitrate film, a cellulose acetate film, a cellulose acetate butyrate film, a cellulose acetate propionate film, a polystyrene film, a polyethylene terephthalate film, a polycarbonate film and a laminate of these resins, a thin glass film and paper, etc. which are used usually for photographic light-sensitive materials. Good results are also obtained using paper coated or laminated with baryta or an α-olefin polymer, particularly, a polymer of an α-olefin having from 2 to 10 carbon atoms, such as polyethylene, polypropylene or a ethylene-butene copolymer, etc., and a plastic film the surface of which has been roughed as described in Japanese Patent Publication No. 19068/72 to improve adhesiveness to other high molecular weight materials and to improve printability.

A transparent support or an opaque support can be selected from the above-described supports depending on the use of the light-sensitive material. As a transparent support, not only a colorless transparent support but also a colored transparent support obtained by adding dyes or pigments to a transparent support may be used. Use of a colored transparent support for X-ray films is described in *J. SMPTE,* Vol. 67, page 296 (1958).

Examples of opaque supports which can be used include not only an intrinsically opaque support such as paper but also a film obtained by adding dyes or pigments such as titanium oxide to a transparent film, a plastic film the surface of which has been processed in the manner described in Japanese Patent Publication No. 19068/72 and paper or a plastic film to which carbon black or dyes have been added to render it completely light shielding. Where the adhesive strength between the support and the photographic emulsion layer is insufficient, a layer which is adhesive to both of the support and the emulsion layer is employed as a subbing layer. Further, in order to further improve the adhesive property, the surface of the support may be subjected to a preliminary treatment such as a corona discharge treatment, an ultraviolet light treatment or flame treatment, etc.

As described above, the photographic light-sensitive material used in the present invention comprises a support and a dye image providing unit layer on the support. A multilayer color photographic light-sensitive material for providing multicolor images has at least two dye image providing unit layers wherein each layer first records light having a certain wavelength range. The unit layers contain a light-sensitive silver salt which is generally sensitive to light having a certain wavelength range and is usually combined with a photographic coupler. In order to prevent the occurrence of any color mixing between the dye image providing unit layers, the unit layers are effectively separated by a barrier layer, an intermediate layer, a layer containing an agent for removing the oxidation product of a developing agent or another layer. Methods of effectively separating the unit layers are known in the photographic field and have been utilized in many commercial color light-sensitive materials. Further, a light-sensitive material having a layer for preventing development contamination as described in U.S. Pat. Nos. 3,737,317, 3,892,572 and 3,984,245 can be used for the present invention.

The present invention provides excellent advantages as compared with the prior methods. Some of these advantages are described below.

First, less fogging occurs.

Second, a residual color is not formed on the processed light-sensitive material, because the precursor used in the present invention is colorless after processing with the activator bath.

Third, unprocessed light-sensitive material has good stability with the lapse of time.

The present invention will be explained in greater detail with reference to the following examples, but the present invention should not be construed as being limited thereto.

EXAMPLE 1

The pH dependence of a rate of reaction wherein the precursor of a color developing agent represented by the general formula (I) according to the present invention releases a developing agent, that is, hydrolysis reaction of the precursor was determined in the following manner. Compound (1) according to the present invention and Comparative Compound A having the structure shown below were used.

COMPARATIVE COMPOUND A

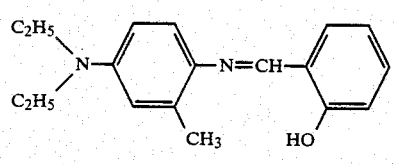

Each of these compounds were dissolved in ethyl alcohol to prepare an ethyl alcohol solution of a precursor of a developing agent (concentration: $10^{-2}$ mol/liter). 1 cc of the solution thus prepared was mixed with 50 cc of 6 kinds of pH buffer solutions having pH of from 5.0 to 14.0 and the rate of hydrolysis reaction of the precursor of developing agent at 25° C. was determined by tracing the change in the spectral absorption of the solution. The analysis of the constants of the reaction rate were carried out supposing that the reaction is a first-order reaction. The constants of the reaction rates thus obtained are shown in Table 1 below.

TABLE 1

| Compound | pH 5.0 | 7.0 | 9.0 | 11.0 | 13.0 | 14.0 |
|---|---|---|---|---|---|---|
| (1) [Present Invention] | $7.9 \times 10^{-5}$ | $8.9 \times 10^{-6}$ | $1.0 \times 10^{-5}$ | $2.5 \times 10^{-4}$ | $7.1 \times 10^{-3}$ | $11 \times 10^{-3}$ |
| A [Comparison] | $1 \times 10^{-3}$ | $6.3 \times 10^{--5}$ | $2.5 \times 10^{-4}$ | $4.5 \times 10^{-3}$ | $13 \times 10^{-3}$ | $7.9 \times 10^{-3}$ |

It is desired that a precursor of color developing agent is present in the form of precursor during preservation of the photographic light-sensitive material containing the precursor without subjecting to hydrolysis and it is hydrolyzed to release a developing agent only when the photographic light-sensitive material is immersed in an alkaline developing solution. In other words, a large difference in the rate of hydrolysis reaction of the precursor between in neutral condition and in alkaline condition is desirable.

From the results shown in Table 1 above, it is apparent that Compound (1) according to the present invention shows the small rate of hydrolysis reaction in neutral condition as about one figure in comparison with Comparative Compound A while the rates of hydrolysis reaction of Compound (I) in highly alkaline condition is almost same as that of Comparative Compound A, which means that the compound according to the present invention has a larger difference of the rate of reaction between in neutral condition and in alkaline condition in contrast to the comparative compound.

EXAMPLE 2

A multilayer color paper photographic light-sensitive material was prepared by coating layers having the compositions shown below on a paper support laminated with polyethylene.

Layer-1: Developing agent containing layer

Compound (3) according to the present invention was dispersed using dibutyl phthalate and ethyl acetate and coated at a coating amount of 1.5 g/m$^2$.

| | |
|---|---|
| Gelatin | 4.0 g/m$^2$ |
| Dibutyl phthalate | 750 mg/m$^2$ |
| Ethyl acetate | 750 mg/m$^2$ |
| Hardening agent | 40 mg/m$^2$ |

Layer-2: Intermediate layer

| | |
|---|---|
| Gelatin | 1.0 g/m$^2$ |

Layer-3: Blue-sensitive silver halide emulsion layer

Yellow coupler (Y-1) dissolved in dioctyl butyl phosphate was dispersed in a silver chlorobromide (bromide: 80 mol%) emulsion and coated.

| | |
|---|---|
| Silver | 0.4 g/m$^2$ |
| Coupler | $8 \times 10^{-4}$ mol/m$^2$ |
| Gelatin | 1.5 g/m$^2$ |
| Oil | 0.3 g/m$^2$ |
| Hardening agent | 15 mg/m$^2$ |

Layer-4: Intermediate Layer

| | |
|---|---|
| Gelatin | 1.0 g/m$^2$ |

Layer-5: Green-sensitive silver halide emulsion layer

Magenta coupler (M-1) dissolved in tricresyl phosphate was dispersed in a silver chlorobromide (bromide: 60 mol%) emulsion and coated.

| | |
|---|---|
| Silver | 0.4 g/m$^2$ |
| Coupler | $5.8 \times 10^{-4}$ mol/m$^2$ |
| Gelatin | 1.5 g/m$^2$ |
| Oil | 0.35 g/m$^2$ |
| Hardening agent | 15 mg/m$^2$ |

Layer-6: Intermediate layer 2-(2-Hydroxy-3-sec-butyl-5-tert-butylphenyl)benzotriazole dissolved in dibutyl phthalate was dispersed and coated.

| | |
|---|---|
| Gelatin | 1.2 g/m$^2$ |
| Oil | 0.25 g/m$^2$ |
| Benzotriazole (described above) | 1.0 g/m$^2$ |
| Hardening agent | 12 mg/m$^2$ |

Layer-7: Red-sensitive silver halide emulsion layer

Cyan coupler (C-1) dissolved in dibutyl phthalate was dispersed in a silver chlorobromide (bromide: 50 mol%) emulsion and coated.

| | |
|---|---|
| Silver | 0.3 g/m$^2$ |
| Coupler | $8.5 \times 10^{-4}$ mol/m$^2$ |
| Gelatin | 1.5 g/m$^2$ |
| Oil | 0.2 g/m$^2$ |
| Hardening agent | 15 mg/m$^2$ |

Layer-8: Protective layer

| | |
|---|---|
| Gelatin | 1.0 g/m$^2$ |

The compounds used had the following formulae.

Hardening agent $CH_2{=}CH{-}SO_2{-}CH_2{-}O{-}CH_2{-}SO_2{-}CH{=}CH_2$

Yellow coupler (Y-1)

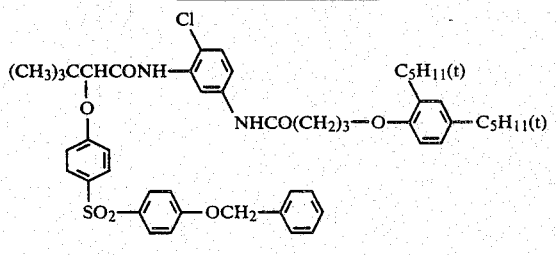

Magenta coupler (M-1)

-continued

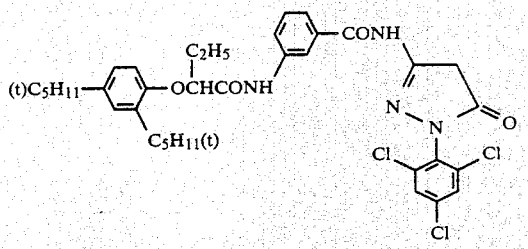

Cyan coupler (C-1)

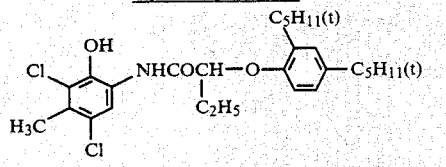

The photographic material thus prepared was designated Sample 1.

Samples 2 and 3 were prepared in the same manner as described in Sample 1 except that 1.0 g/m$^2$ of Compound A having the structure shown below and 1.2 g/m$^2$ of Compound B described below were used in place of Compound (3) in Layer-1 of Sample 1, respectively.

Compound A

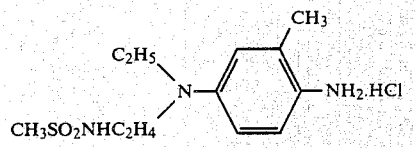

Compound B

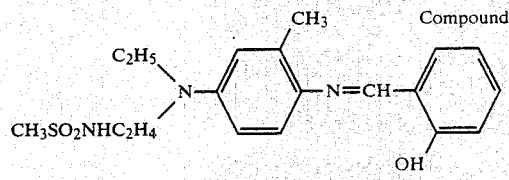

Samples 1, 2 and 3 were exposed to light through a step wedge and subjected to the following processing.

| Processing Step | Temperature | Time |
|---|---|---|
| Activator Development | 38° C. | 2 min |
| Bleach-Fixing | 38° C. | 1 min |
| Washing with water | 38° C. | 2 min |
| Drying | 70° C. | 2 min |

The processing solutions used had the following compositions.

| | |
|---|---|
| Activator Solution | |
| Benzyl alcohol | 15 ml |
| Sodium sulfite | 1.5 g |
| Potassium bromide | 0.6 g |
| Sodium carbonate · monohydrate | 30 g |
| Water to make | 1 liter |
| | (pH was adjusted to 10.0) |
| Bleach-Fixing Solution | |
| Ammonium thiosulfate | 130 g |
| Sodium metabisulfite | 14 g |
| Sodium sulfite · anhydrous | 3 g |
| Ammonium Fe (III) ethylenediaminetetraacetate | 65 g |
| Water to make | 1 liter |

-continued (pH was adjusted to 6.7 to 6.8)

The maximum density and the fog density of the sample thus processed were measured using a Macbeth densitometer. The results obtained are shown in Table 2 below.

TABLE 2

| Sample No. | Fog Density Y | Fog Density M | Fog Density C | Maximum Density Y | Maximum Density M | Maximum Density C |
|---|---|---|---|---|---|---|
| 1 (Present Invention) | 0.12 | 0.20 | 0.18 | 2.43 | 2.75 | 2.52 |
| 2 (Comparison) | 0.45 | 0.30 | 0.25 | 2.50 | 2.84 | 2.60 |
| 3 (Comparison) | 0.30 | 0.22 | 0.20 | 1.20 | 1.35 | 1.08 |

It is apparent from the results shown in Table 2 above that in Sample 1 according to the present invention, the fog density is maintained in a low level and the sufficiently high maximum density is obtained. On the contrary, Sample 2 provides the high fog density and is poor in the stability of the unprocessed light-sensitive material with the lapse of time, and Sample 3 has relatively low fog density but insufficient maximum density.

EXAMPLE 3

1.2 g of 2',6'-dihydroxyundecanophenone, that is, a black color forming coupler as described in Japanese Patent Application (OPI) No. 172336/82 and 1 g of Compound (1) according to the present invention as a precursor of a developing agent was dissolved at 40° C. in a mixture solution of 1.5 ml of dibutyl phthalate and 2.5 ml of ethyl acetate. The solution was mixed with 10 g of a 10% aqueous gelatin solution, to which was added 0.05 g of sodium alkylbenzenesulfonate and the mixture was dispersed using a homogenizer. To the dispersion thus prepared was added 5 g of a 10% aqueous gelatin solution containing 0.2 g 4-hydroxymethyl-4-methyl-1-phenyl-3-pyrazolidinone and 0.05 g of ascorbic acid whereby the coupler dispersion containing the precursor of a developing agent was prepared. The coupler dispersion was mixed with a silver iodobromide (particle size: 1.2 μm, iodide: 2 mole%) emulsion and the mixture was coated on a transparent polyethylene terephthalate support to prepare a sample. The coating amounts of silver and Compound (1) in this sample were 2 g/m$^2$ and 2.2 g/m$^2$, respectively. This sample was designated Sample 4.

Sample 5 was prepared in the same manner as described in Sample 4 except that 0.65 g of Compound C having the structure shown below was used in place of the precursor of a developing agent in Sample 4.

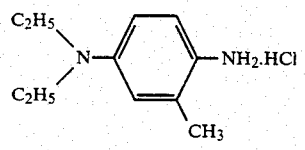

Compound C

Also, Sample 6 was prepared in the same manner as described in Sample 5 except using 0.87 g of Compound D having the structure shown below in place of Compound C.

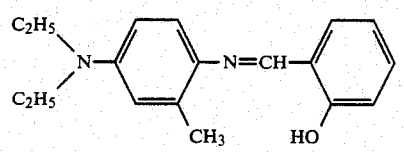

Compound D (described in U.S. Pat. No. 3,342,599)

Further, Sample 7 was prepared in the same manner as described in Sample 5 except using 1.33 g of Compound E having the structure shown below in place of Compound C.

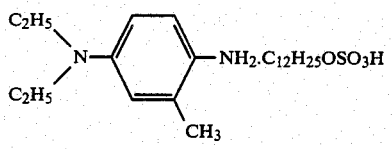

Compound E (described in Japanese Patent Application (OPI) No. 16133/81)

Samples 4, 5, 6 and 7 were exposed to light through a stepwedge and subjected to the following processing.

| Processing Step | Temperature | Time |
|---|---|---|
| Activator Development | 35° C. | 25 sec. |
| Fixing | 35° C. | 25 sec. |
| Washing with water | 33° C. | 20 sec. |

The processing solutions used had the following compositions.

| | |
|---|---|
| Activator Solution | |
| Benzyl alcohol | 10 ml |
| Potassium bromide | 5 g |
| 5-Methylbenzotriazole | 0.05 g |
| Sodium hydroxide | 10 g |
| Water to make | 1 liter |
| | (pH was about 13.2 at 25° C.) |
| Fixing Solution | |
| Ammonium thiosulfate | 175 g |
| Sodium sulfite · anhydrous | 15 g |
| Glacial acetic acid | 12 ml |
| Sodium metaborate | 15 g |
| Potassium alum | 20 g |
| Water to make | .1 liter |

The results obtained are shown in Table 3 below.

Furthermore, Samples 4, 5, 6 and were subjected to a accelerated ageing test under the condition of 50° C. and 70% RH for 3 days and then exposed to light and processed in the same manner as described above. The results obtained are also shown in Table 3 below.

TABLE 3

| Sample No. | Compound | Fog | Maximum Density | Relative Sensitivity |
|---|---|---|---|---|
| 4 (Present Invention) | (1) | 0.25 | 2.87 | 100 |
| 5 (Comparison) | C | 0.51 | 2.31 | 88 |
| 6 (Comparison) | D | 0.21 | 0.95 | 30 |
| 7 (Comparison) | E | 0.63 | 2.12 | 75 |
| [After Accelerated Ageing Test] | | | | |
| 4 (Present Invention) | (1) | 0.38 | 2.54 | 85 |
| 5 (Comparison) | C | 0.95 | 1.91 | 64 |
| 6 (Comparison) | D | 0.40 | 1.12 | 27 |
| 7 (Comparison) | E | 1.05 | 1.76 | 54 |

It is apparent from the results shown in Table 3 above that Compound (1) according to the present invention has excellent properties in that it provides high maximum density with only a low level of fog in comparison with Compounds C and E employed for comparison. On the contrary, Compound D has a low maximum density while having a lower fog than the compound according to the present invention and thus it can not be practically employed. Further, Compound (1) according to the present invention exhibits a smaller increase in fog as well as smaller decreases in the maximum density and the sensitivity in comparison with Compounds C, D and E, even after accelerated ageing. Therefore, it is understood from this example that the compound according to the present invention has extremely good properties as a precursor of a color developing agent.

While the invention has been described in detail and with reference to specific embodiments thereof, it will be apparent to one skilled in the art that various changes and modifications can be made therein without departing from the spirit and scope thereof.

What is claimed is:

1. A method for forming a photographic image, comprising the steps of:

providing a silver halide photographic light-sensitive material comprising a support base having position thereon a diffusion resistant coupler, a light-sensitive silver halide and organic metal complex represented by the following general formula (I):

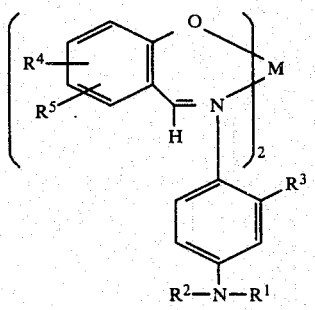

wherein M represents a divalent metal atom; $R^1$ and $R^2$, which may be the same or different, each represents an alkyl group having from 1 to 5 carbon atoms, a hydroxyalkyl group having from 1 to 5 carbon atoms, an alkoxyalkyl group having from 2 to 10 carbon atoms or an alkylsulfonamidoalkyl group having from 2 to 10 carbon atoms, or $R^1$ or $R^2$ may be bonded to each other to form a heterocyclic ring together with the nitrogen atom; $R^3$, represents a hydrogen atom, an alkyl group having from 1 to 5 carbon atoms or an alkoxy group having from 1 to 5 carbon atoms; and $R^4$ and $R^5$, which may be the same or different, each represents a hydrogen atom, a halogen atom, a hydroxy group, an amino group, a carboxylic acid group, a sulfonic acid group, an alkoxycarbonyl group, an alkyl group or an alkoxy, or $R^4$ and $R^5$ may be bonded to each other to form a 5-membered or 6-membered ring;

imagewise exposing the material;

developing the material with an activator solution comprising an alkaline processing solution having a pH of from 7 to 14.

2. A method of forming a photographic image as claimed in claim 1, wherein the photographic material developed is subjected to a bleaching process to remove the developed silver.

3. A method of forming a photographic image as claimed in claim 1, wherein the photographic material developed is subjected to a fixing process without removing the developed silver.

4. A method of forming a photographic image as claimed in claim 1, wherein the organic metal complex represented by general formula (I) is a precursor of a color developing agent.

5. A method of forming a photographic image as claimed in claim 1, wherein the divalent metal atom represented by M is iron, cobalt, nickel, copper or zinc.

6. A method of forming a photographic image as claimed in claim 1, wherein the alkoxycarbonyl group represented by $R^5$ is an alkoxycarbonyl group having from 2 to 5 carbon atoms; the alkyl group represented by $R^5$ is an alkyl group having from 1 to 5 carbon atoms; and the alkoxy group represented by $R^5$ is an alkoxy group having from 1 to 5 carbon atoms.

7. A method of forming a photographic image as claimed in claim 1, wherein $R^1$ and $R^2$ each represents an alkyl group having from 1 to 5 carbon atoms and $R^3$ represents an alkyl group having from 1 to 5 carbon atoms.

8. A method of forming a photographic image as claimed in claim 1, wherein the compound represented by the general formula (I) is present in the photographic light-sensitive material in an amount of from 0.1 to 10 molar times the total amount of silver per unit area of the photographic light-sensitive material.

* * * * *